US005301954A

United States Patent [19]

Wotring

[11] Patent Number: 5,301,954

[45] Date of Patent: Apr. 12, 1994

[54] APPARATUS FOR THROWING AND CATCHING OBJECTS

[75] Inventor: Randall C. Wotring, Livonia, Mich.

[73] Assignee: Saturnian I, Plymouth, Mich.

[21] Appl. No.: 965,440

[22] Filed: Oct. 23, 1992

[51] Int. Cl.[5] ..... A63B 67/00

[52] U.S. Cl. ..... 273/323; 273/67 R; 273/346; 273/DIG. 30

[58] Field of Search ..... 273/67 R, 318, 323, 273/324, 346

[56] References Cited

U.S. PATENT DOCUMENTS

| | | | |
|---|---|---|---|
| 2,465,808 | 3/1949 | Killam | 273/324 |
| 3,342,491 | 9/1967 | Padovani | 273/324 |
| 3,467,381 | 9/1969 | Kreiss | 273/324 |
| 4,155,552 | 5/1979 | Jacobo et al. | 273/380 X |
| 4,234,183 | 11/1981 | Stephens | 273/318 |
| 4,303,247 | 12/1981 | Fain | 273/324 |
| 4,538,817 | 9/1985 | Ramella | 273/380 |
| 4,844,478 | 7/1984 | Kessler | 273/67 R X |

FOREIGN PATENT DOCUMENTS

| | | | |
|---|---|---|---|
| 433407 | 8/1926 | Fed. Rep. of Germany | 273/324 |

*Primary Examiner*—William H. Grieb

*Attorney, Agent, or Firm*—Harness, Dickey & Pierce

[57] ABSTRACT

An object throwing and catching apparatus having a strap with handles and bridging members to define an object receiving area around netting or solid material. Elastic strips are present in the bridging members to cause them to contract creating a cradle effect in the netting. Such a cradle enhances control of the object to be thrown and caught and enables the object to be easily catapulted via the snap action created by the cradle. For use with water balloons, bursting clips and netting knots may be provided on the apparatus to facilitate breakage of the water balloon. VELCRO fasteners may also be provided on the receiving surface of the apparatus as well as the ball to be caught to facilitate overall control.

21 Claims, 1 Drawing Sheet

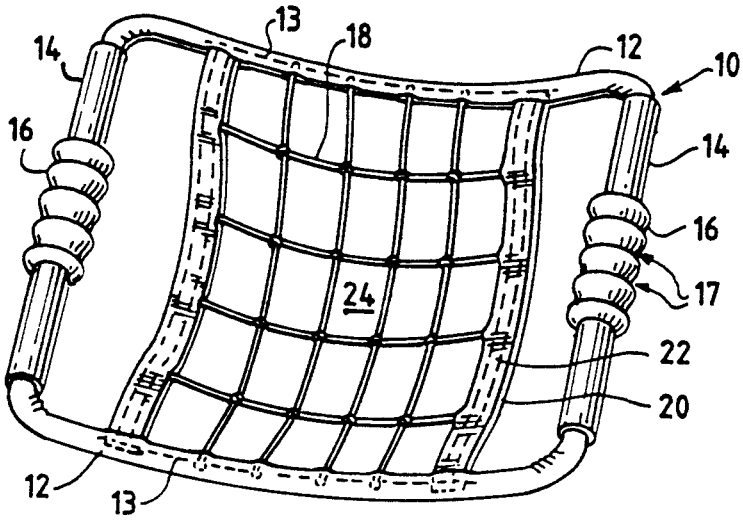
Fig. 1
Fig. 2
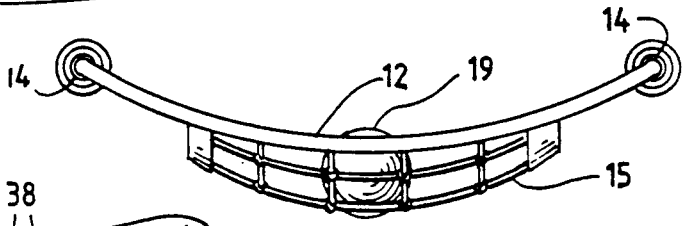
Fig. 3
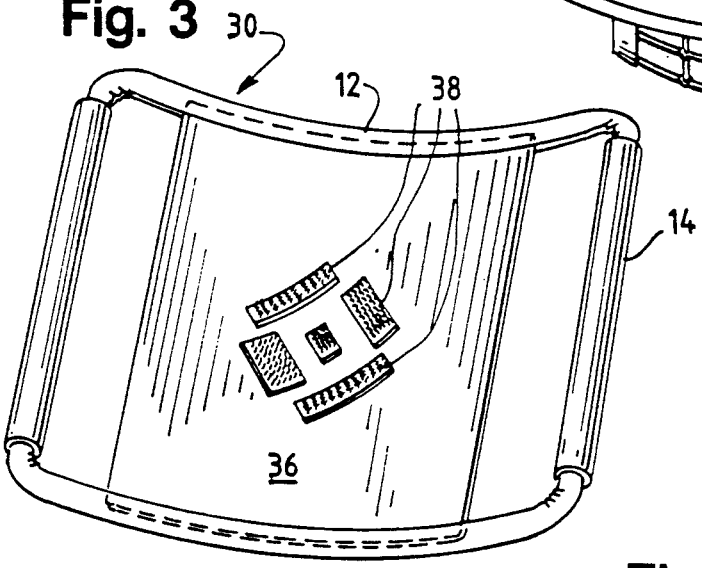
Fig. 4
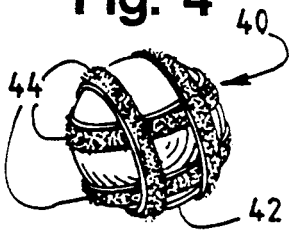
Fig. 5
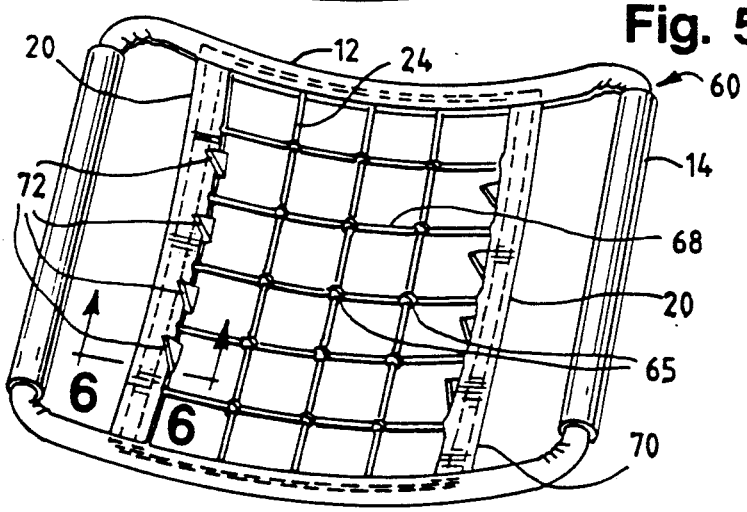
Fig. 6
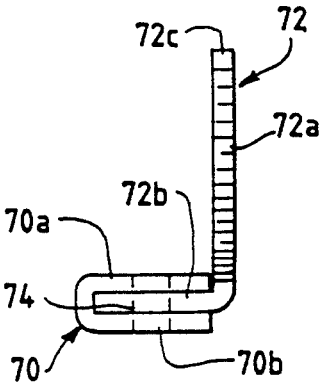

APPARATUS FOR THROWING AND CATCHING OBJECTS

BACKGROUND OF THE INVENTION

The present invention relates generally to an apparatus for throwing and catching objects. More specifically, the present invention relates to a game or sports apparatus for throwing and catching balls, water balloons or the like that can be propelled.

In prior art game and sporting apparatus, particularly throwing and catching devices, it has been well known to employ two handles with a length or area of material therebetween to catch and hold the object being propelled. Typically, at least two such devices are used so a number of people may pass the object between one other to enhance enjoyment and interest in the game. Such a prior art device is disclosed in U.S. Pat. No. 3,342,491 issued to Padovani. This patent discloses a projecting and catching device which employs two handles with a resilient net disposed therebetween to provide the surface for contact the ball during play. The net has an overall shape that is fixed and predetermined at the time of manufacture. The netting simply bridges the two handles to provide a surface that may be stretched according to the desire of the user. U.S. Pat. No. 3,342,491 provides a flat netting surface.

A device sold by Kenner Toys under the trademark SKYBALL also employs a flexible netting with handles for throwing and catching objects, preferably balls. The SKYBALL device provides no means to retain and control the ball on the netting during catching or throwing.

Another prior art game apparatus, U.S. Pat. No. 4,234,183 issued to Stephens, has similar features as U.S. Pat. No. 3,342,491 but also includes a ball locating opening to maintain the ball on the netting portion of the device. As in the Padovani patent, U.S. Pat. No. 4,234,183 discloses a flat netting surface for contact with the object to be thrown or caught.

A flat surfaced throwing and catching game, as in U.S. Pat. No. 4,303,247 issued to Faln, discloses a device where the ball has hook and loop fasteners, such as VELCRO, while the surface of the device has a series of fasteners complimentary to those on the ball. The material of the device is flexible and requires the presence of the VELCRO thereon to secure and maintain the ball on its surface.

Non-flat ball projector and catching devices are known, as disclosed in U.S. Pat. No. 3,467,381 issued to Kreiss. This device a has a cup to hold the ball or object with two retractable members which trap the ball inside the cup. To release the ball, opposing handles connected to the retractable members are pulled away from each other opening a gap large enough for the ball to fit through. This device requires many mechanical parts which adds significantly to the complexity and cost of manufacture.

Therefore, it is desirable in the field of throwing and catching devices for objects, particularly balls, to have a device that is easy and fun to use with comfort while providing a sportlike game. It is further desirable to have a popular product that can be manufactured inexpensively. A throwing and catching device that employs a unique means for controlling the ball during throwing or catching is also desired.

SUMMARY OF THE INVENTION

The present invention preserves the advantages of the prior object throwing and catching devices. In addition, it provides new advantages not found in currently available object throwing and catching games, and overcomes many of the disadvantages of such currently available devices.

The invention is generally directed to a novel and unique device for throwing and catching objects. The present invention is particularly well suited for the throwing and catching of spheroid objects. It may also be used for the throwing and catching of water balloons or the like. The preferred embodiment of the present invention is suited for the throwing and catching of balls while alternative embodiments are suited for modified balls with VELCRO fasteners or water balloons. The embodiments of the present invention includes unique features not found in prior art apparatuses.

The preferred embodiment of the present invention includes a netting material connected to a pair of supporting handles to be held by the user during play on each of the handles a cushioned handle extension may be provided for additional control. The netting is preferably substantially square in shape with two opposing sides, which are perpendicular to the handles, being bounded and reinforced by strips of flexible but non-elastic material such as polypropylene. The sides of the netting, which are parallel to the handles, are also bounded and reinforced by the flexible material but also include an elastic member. Elastic is sewn into the material parallel to the handles with the elastic in its expanded or stretched state so that after sewing, those parallel members contract while the perpendicular members do not. As a result, a cradle effect is created to assist in controlling the ball or object during play. Further, the elastic members provide an additional snap for catapulting the ball out of the device. As a result, the ball can be propelled longer distances and higher than with prior art devices.

In another embodiment of the invention, Velcro fasteners may be carried on the surface of both the netting and the ball or object to be thrown or caught. This embodiment may also employ the structure of the preferred embodiment where elastic is sewn with opposing side members of the device to create a cradle to control of the ball.

In another embodiment for use with water balloons, bursting clips are provided on the side edges of the netting, preferably on the edges which are parallel to the handles. The bursting clips puncture and break an incoming water balloon if the user does not catch the balloon in the center of the device. Such a feature provides additional fun and challenge to the game. Also, knotted netting may be employed to aid in bursting of the water balloons when they are not properly caught.

It is therefore an object of the present invention to provide a apparatus for throwing and catching an object.

Another object of the invention is to provide a throwing and catching apparatus having an improved means for controlling the object to be thrown and assist in the catching of the object.

It is a further object of the invention to provide an apparatus with a improved catapult action to propel the object further than prior art devices.

It is yet another object of the invention to provide an apparatus having hook and loop fasteners for added control of an object to be thrown or caught having complimentary fasteners.

A further object of the invention is to provide an apparatus for throwing and catching water balloons which includes a means for breaking incoming balloons which are not accurately caught.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 1 is a perspective view of a throwing and catching apparatus of the present invention having a netting reinforced by material with elastic therein;

FIG. 2 is a side view of the apparatus of FIG. 1 showing the cradle effect;

FIG. 3 is a top view of an alternative embodiment of the present invention with hook and loop fasteners carried on the carrying surface of the device;

FIG. 4 is a perspective view of a ball having hook and loop fasteners carried on its surface to be used in conjunction with the embodiment of FIG. 3;

FIG. 5 is a top view of another alternative embodiment of the present invention for use with throwing and catching water balloons; and FIG. 6 is a side view of a bursting clip used in conjunction with the embodiment of FIG. 5.

DETAILED DESCRIPTION OF THE PREFERRED EMBODIMENT

Referring to FIG. 1, the preferred embodiment of the throwing and catching apparatus 10 of the present invention is generally shown to include a supporting strap 12 which preferably forms a continuous loop though handles 14. Bridge members 20 are located between opposing sides of strap 12. Within bridge members 20 are lengths of elastic 22 to provide bridge members 20 with a spring-like stretchable property. Between strap 12 and bridge members 20, netting 24 is provided to serve as a playing surface for the object to be thrown or caught. On handles 14, secondary grips 16 made be provided with grooves or ridges 17 to engage with the fingers of the user to assist and enhance game play and control. Secondary grips 16 may be foam rubber or the like and slipped onto handles 14 or may be integrated into handles 14. The secondary grips 16 allow for spinning of the entire apparatus about the handles 14 to perform tricks, for example.

Still referring to FIG. 1, strap 12 is preferably a length of polypropylene folded along its entire length toward the center of the apparatus to sandwich netting 24 within its fold so that it can be sewn along lines 13. Polypropylene is preferred because it is relatively inexpensive, durable and provides adequate firmness to maintain the structure of the entire apparatus. Bridge members 20 are also sewn into the fold of the strap 12 at its upper and lower ends. Strap 12, prior to sewing, is threaded through hollow tubular handles 14 which are preferable manufactured of PVC plastic to ensure durability and permit slight flexibility to reduce wrist strain of the user. Since the handles are hollow, they are freely slidable on strap 12 which permits the user to execute maneuvers or tricks which require flexibility of the location of the handles. As a result of the foregoing structure, an object catching area is created at netting 24 which is bounded at its upper and lower portions by strap 12 and at its left and right side portions by bridge members 20.

As shown in FIG. 1, netting 24 is a panel having a length and a width defining respective opposing ends and sides which provides the play area of the apparatus. Netting 24 may be flexible nylon which aids in game play and adds overall durability. Netting 24 is a panel of material that may be of a variety of shapes such as square or rectangular. As described above, netting 24 is sewn into the fold of strap 12 as well into a fold of the bridge members 20. As a result, netting 24 is firmly secured within the apparatus. The spacing of the grid of netting is preferably 1 and ½ inches so that it will slow the roll of a ball of approximately 2 and ½ inches in diameter that is received on the netting 24. Such a size is common for game balls such as rubber balls, tennis balls and the like. For the apparatus of the present invention, sponge rubber balls are preferred, however, other balls and other objects may be thrown and caught using the invention as will be described below. It should be appreciated that the spacing of the netting can be scaled according to the size of the ball or object to be used during play.

The present invention is significantly improved over prior art apparatus because it provides a cradle for catching, controlling and throwing an object. As in FIG. 1, netting 24 is bounded on its upper and bottom edges by strap 12 which is somewhat rigid and non-elastic on its left and right sides, netting 24 is bounded by bridge members 20 which are folded similar to strap 12 and sandwich the netting 24 as well as strips of elastic 22. During manufacture, bridge members 20 are sewn over netting 24 and elastic strips 22 when the elastic strips 22 are in their stretched state and while netting 24 is laid flat. After sewing, elastic strips 22 will return to their resting, non-stretched, state. Since bridge members and netting are sewn to the elastic strips, they will contract causing an overall contraction of the apparatus in the vertical direction. As shown in FIG. 21 this contraction creates a cradle or pocket 15 within the apparatus when the handles are released by the user. Also, strap 12 is pulled toward the center of the apparatus due to elastic strips 22. During game play, the object will be trapped with the cradle or pocket 15 which provides the user with complete control of the object in the apparatus which is not found in prior apparatus.

During game play, the user may catch an object by placing the netting portion of the apparatus in the path of the object coming toward his or her direction. To facilitate catching the object thrown at the user, the handles 14 may be pulled apart from one another which are effectively biased by elastic strips 22. Pulling the handles 14 apart causes bridge members to become longer which in turn causes netting 24 to flatten out from its cradled state to provide a larger surface for receiving an incoming object. When the object 19 hits the netting 24, the user preferably permits the handles to become closer to one another so that the bridge members contract up creating cradle 15 again in netting 24. At this point, the object 19 caught is substantially surrounded in the cradle 15 to permit control over the caught object which is not found in prior art devices.

During the operation of throwing with the apparatus of the present invention, it can be seen in FIGS. 1 and 2, that the object 19 may be catapulted or thrown from cradle 15. This operation utilizes the unique snap action of the present invention. To throw the object, the handles 14 are rapidly pulled apart causing the elastic strips 22 and bridge members 20 to elongate causing netting 24 to flatten out of its cradled state. This flattening of the netting creates a catapult effect causing the object with the cradle 15 to be propelled quickly out of the apparatus. During this pulling action, the strap 12 becomes taut and assumes a substantially rectangular shape and will no longer be pulled toward to the center of the apparatus. The configuration of the strap 12 and bridge members 20 define the outer limits of the snap action. When the strap is fully extended, the limit of the pulling action is realized. This snap action is unlike any prior art apparatus in that it provides superior snap catapult action in a structured configuration.

In the preferred embodiment of FIG. 1, the object to be thrown and caught may be a water balloon. Netting of a spacing of 1 and ½ inches is optimal with a water balloon of approximately 4 inches in diameter. Various sized netting may be employed for use with varying sized water balloons. Such a sized netting 24 prevents a water balloon from easily squeezing through the netting 24. Further, it is desired that the netting have a spacing wherein a substantial amount of the netting line can contact the balloon so in the event of high impact, the incoming balloon will break enhancing game challenge and fun.

As shown in FIGS. 5 and 6, various means may be provided to enhance the challenge of the game when the object to be thrown and caught is a water balloon. In FIG. 5, an alternative embodiment, generally shown as 60, has knots 65 which may be provided in the netting 24 to aid in the bursting of an incoming water balloon. Also, bursting clips 72 may be sewn in the material that surrounds the netting 24. It is preferable that the bursting clips 72 be sewn into the bridge members 20. Of course, bursting clips 72 may be positioned along strap 12 or on other places on the apparatus. Detail of the bursting clips 72 is shown in FIG. 6, a crosssectional view through line A—A in FIG. 5. Bridge member 70 is folded over horizontal portion **72*b* of bursting clip 72. Stitches 74 are placed through top bridge member portion 70*a*, horizontal portion 72*b* and through lower bridge member portion 70*b*. When sewing is complete, vertical portion 72*a* of bursting clip 72 stands up so that bursting tip 72*c* points directly upward toward an incoming balloon. Bursting clips 72 may be accompanied by polypropylene edges on bridge members 20 or on the strap 12 to aid in the rigidity of the entire apparatus. These bursting means force the user to catch the water balloon in the center of the netting 24** with finesse. Overall, the addition of bursting clips and rigid edges on the structure of the apparatus of the present invention serves to increase the likelihood that an incoming water balloon will burst upon contact with the apparatus to enhance the challenge and fun of the game.

A further embodiment of the present invention is shown in FIGS. 3 and 4. Apparatus 30 has a solid receiving surface 36 bound by strap 12. On surface 36, hook and loop fasteners, such as VELCRO, are provided which engage with similar fasteners 44 provided on the surface 42 of ball 40 shown in FIG. 4. The VELCRO fasteners assist in the control on the ball 42 when it is within the cradle of the apparatus. The strong snap action of the present invention permits easy release of the ball 40 from the fasteners 38 on receiving surface 36.

In each of the foregoing embodiments, it is preferred that the bridge members 20 include elastic strips 22, as described above in FIG. 1, to create a cradle 15 for assisting in the overall control of the object to be thrown and caught. However, the present invention may not necessarily include elastic strips 22 but may have a sag in the netting or receiving material to create a cradle. Further, various combinations of the above-described features of the present invention may be included in a single apparatus to fit the desired application and usage.

It will be appreciated by those skilled in the art that various changes and modifications can be made to the illustrated embodiments without departing from the spirit of the present invention. All such modifications and changes are intended to be covered by the appended claims.

What is claimed is:

1. An apparatus for catching and throwing an object, comprising:

a panel of flexible sheet material having opposing ends and sides defining a length and a width sufficient to receive said object;

a plurality of elongated straps connected to said opposing sides of said panel;

a plurality of handles connected to said straps;

a plurality of elastic bridge members connected to said elongated straps thereby contracting said panel to form said panel into a generally cradle shaped receptacle for said object; and means for connecting said handles to said elongated straps so that pulling said handles away from one another places said elongated straps in tension and causes said elastic bridge members to expand thereby expanding the panel to form said panel into a generally flat shape.

2. The apparatus of claim 1, wherein said panel is flexible netting.

3. The apparatus of claim 2, wherein said netting is made of nylon.

4. The apparatus of claim 2, wherein said netting is made of polypropylene.

5. The apparatus of claim 1, wherein said panel is flexible cloth.

6. The apparatus of claim 1, wherein said elastic bridge members are elastic strips sewn into said opposing ends of said panel.

7. The apparatus of claim 1, wherein said straps are elastic strips sewn into said opposing sides of said flexible panel.

8. The apparatus of claim 1, wherein both said straps and said elastic bridge members are elastic strips sewn into said opposing sides and said opposing ends of said panel.

9. The apparatus of claim 1, wherein said panel and said object carry complimentary hook and loop fasteners for engagement with each other.

10. The apparatus of claim 1, wherein said object is a water balloon and further including at least one balloon piercing element mounted to said panel.

11. The apparatus of claim 1, wherein a means for bursting said object is carried on said panel when said object is a water balloon.

12. The apparatus of claim 11, wherein said means for bursting are bursting clips with pointed tips attached to said panel.

13. The apparatus of claim 1, wherein said panel is netting with knots thereon for bursting said object when said object is a water balloon.

14. A game apparatus for catching and throwing a water balloon, comprising:

a panel of flexible sheet material having opposing ends and sides defining a length and width sufficient to receive said water balloon;

a plurality of elongated straps connected to said opposing sides of said panel;

a plurality of handles connected to said straps;

a plurality of elastic bridge members connected to said elongated straps thereby contracting said panel into a generally cradle shaped receptacle for said water balloon;

means for connecting said handles to said elongated straps so that pulling said handles away from one another places said elongated straps in tension and causes said elastic bridge members to expand to form said panel into a generally flat shape; and means for aiding in the bursting of said water balloon connected to said panel.

15. The game apparatus of claim 14, wherein said panel is made of flexible netting.

16. The apparatus of claim 14, wherein said means for aiding are bursting clips connected to said sides and said ends of said panel to aid in the bursting of said water balloon when said water balloon is not received on said panel.

17. The apparatus of claim 15, wherein said means for aiding are bursting knots disposed on said flexible netting to aid in the bursting of said water balloon when said water balloon is received with high impact on said flexible netting.

18. The apparatus of claim 15, wherein said means for aiding in the bursting are bursting clips and bursting knots disposed on said flexible netting.

19. An apparatus for catching and throwing a water balloon, comprising:

a panel of flexible sheet material having opposing ends and sides defining a length and width sufficient to receive said water balloon;

handles connected to said opposing ends of said panel;

means for elastically contracting said panel to form said panel into a generally cradle shaped receptacle for said water balloon;

means for connecting said handles to said panel so that pulling said handles away from one another causes said panel to expand to form a generally flat shape; and bursting clips with pointed tips for bursting said water balloon.

20. A game apparatus for catching and throwing a water balloon, comprising:

a panel of flexible sheet material having opposing ends and sides defining a length and width sufficient to receive said water balloon;

handles connected to said opposing ends of said panel; and bursting clips connected to said panel for bursting of said water balloon when said water balloon is not received on said panel.

21. A game apparatus for catching and throwing a water balloon, comprising:

a panel of flexible netting having opposing ends and sides defining a length and width sufficient to receive said water balloon;

handles connected to said opposing ends of said panel; and bursting clips and bursting knots disposed on said netting for bursting of said water balloon connected to said panel.

* * * * *

UNITED STATES PATENT AND TRADEMARK OFFICE

CERTIFICATE OF CORRECTION

PATENT NO. : 5,301,954

DATED : Apr. 12, 1994

INVENTOR(S) : Randall C. Wotring

It is certified that error appears in the above-identified patent and that said Letters Patent is hereby corrected as shown below:

On Title Page, Under References Cited, Line 8, Kessler Patent, Paper 3, Dated 3/9/93 Form PTO 892, Doc. B "1984" should be --1989--;

Col. 1, Line 18, "other" should be --another--;

Col. 1 Line 23, "contact" should be --contacting--;

Col. 1, Line 43, "Faln" should be --Fain--;

Col. 1, Line 52, after "device, delete --a--;

Col. 1, Line 47, "complimentary" should be --complementary--;

Col. 2, Line 18, "includes" should be --include--;

Col. 2, Line 41, "Velcro" should be --VELCRO®--;

UNITED STATES PATENT AND TRADEMARK OFFICE

CERTIFICATE OF CORRECTION

PATENT NO. : 5,301,954

DATED : Apr. 12, 1994

INVENTOR(S) : Randall C. Wotring

It is certified that error appears in the above-identified patent and that said Letters Patent is hereby corrected as shown below:

Col. 2, Line 47, delete "of";

Col. 2, Line 58, "a" should be --an--;

Col. 2, Line 65, "a" should be --an--;

Col. 3, Line 2, "complimentary" should be --complementary--;

Col. 3, Line 45, "made" should be --may--;

Col. 3, Line 63, "preferable" should be --preferably--;

Col. 4, Line 12, after "well" insert --as--;

Col. 4, Line 41, "21" should be --2--;

Col. 6, Line 55, Claim 9, "complimentary should be --complementary--; and

Col. 6, Line 55, Claim 9, after "loop insert --(VELCRO®)--.

Signed and Sealed this

Twenty-first Day of March, 1995

*Attest:*

Bruce Lehman

BRUCE LEHMAN

*Attesting Officer*

*Commissioner of Patents and Trademarks*